US005237298A

United States Patent [19]

Boom et al.

[11] Patent Number: 5,237,298

[45] Date of Patent: Aug. 17, 1993

[54] SUPERCONDUCTING ENERGY STORAGE MAGNET

[75] Inventors: Roger W. Boom; Yehia M. Eyssa; Mostafa K. Abdelsalam; Xianrui Huang, all of Madison, Wis.

[73] Assignee: Wisconsin Alumni Research Foundation, Madison, Wis.

[21] Appl. No.: 586,496

[22] Filed: Sep. 21, 1990

[51] Int. Cl.[5] ..... H01F 7/22

[52] U.S. Cl. ..... 335/216; 335/299; 335/300; 505/879

[58] Field of Search ..... 335/216, 299, 300; 505/1, 879, 892, 894

[56] References Cited

U.S. PATENT DOCUMENTS

| | | | |
|---|---|---|---|
| 3,444,495 | 10/1967 | Thomas | 335/216 |
| 3,514,730 | 3/1968 | Kassner | 335/216 |
| 3,980,981 | 9/1976 | Boom et al. | 335/216 |
| 4,482,878 | 11/1984 | Burgeson et al. | 335/216 |
| 4,622,531 | 11/1986 | Eyssa et al. | 335/216 |
| 4,682,134 | 7/1987 | Laskaris | 335/300 X |
| 5,115,219 | 5/1992 | Withers et al. | 335/216 |

OTHER PUBLICATIONS

B. Nilsson and Y. M. Eyssa, "Constant Tension Winding in a Single Layer Rippled Soleniods," IEEE Trans. on Magnetics, vol. MAG-19, No. 3, 1983, pp. 354-358.

*Primary Examiner*—Leo P. Picard
*Assistant Examiner*—Trinidad Korka
*Attorney, Agent, or Firm*—Foley & Lardner

[57] ABSTRACT

A superconducting magnet is formed having composite conductors arrayed in coils having turns which lie on a surface defining substantially a frustum of a cone. The conical angle with respect to the central axis is preferably selected such that the magnetic pressure on the coil at the widest portion of the cone is substantially zero. The magnet structure is adapted for use as an energy storage magnet mounted in an earthen trench or tunnel where the strength the surrounding soil is lower at the top of the trench or tunnel than at the bottom. The composite conductor may be formed having a ripple shape to minimize stresses during charge up and discharge and has a shape for each ripple selected such that the conductor undergoes a minimum amount of bending during the charge and discharge cycle. By minimizing bending, the working of the normal conductor in the composite conductor is minimized, thereby reducing the increase in resistance of the normal conductor that occurs over time as the conductor undergoes bending during numerous charge and discharge cycles.

24 Claims, 10 Drawing Sheets

SUPERCONDUCTING ENERGY STORAGE MAGNET

This invention was made with United States government support awarded by the NASA Headquarters (NASA), Grant # NAG-3-1041. The United States Government has certain rights in this invention.

FIELD OF THE INVENTION

This invention pertains generally to the field of electrical energy storage magnets and particularly to superconducting storage magnets with support structure.

BACKGROUND OF THE INVENTION

Energy storage using large superconducting magnets has been proposed for leveling daily load requirements on electrical utility systems. Excess energy generated during off-peak hours can be stored and later returned to the power grid during high demand periods. By connecting the superconducting energy storage magnet to the power system with a bridge-type inverter, it is possible to obtain very efficient energy transfer between the storage magnet and the power system, as more fully described in U.S. Pat. No. 4,122,512 to Peterson, et al.

The large energy storage magnets proposed for storing sufficient energy to allow load leveling on a power grid utilize multiple turns of composite normal and superconducting material. The current flowing in the turns of the magnet naturally produces a net magnetic field and any conductor in the field will experience a force at each point on the conductor oriented at right angles to the current and the magnetic field. Since superconducting magnets of the size proposed for electrical system energy storage will conduct extremely large currents and will generate strong magnetic fields, the forces experienced by the conductors will be very large. If the turns of the magnet coil were formed as conventional circular turns, and were unsupported, the tension at any cross-section in the conductor would be equal to BIR, where B is the component of the magnetic field experienced by the conductor perpendicular to the plane of the conductor (axial magnetic field), I is the current in the conductor, and R is the radius of curvature of the turn. In the large energy storage magnets under consideration, all of these factors will be very large, e.g., several hundred thousand amperes will be conducted in a field of several teslas in a solenoid magnet having a radius which may be several hundred meters. Since no conductor by itself could possibly withstand the forces that would be exerted on the conductor under these conditions, an external support structure capable of resisting the large loads imposed on the conductor is necessary.

One approach to the problem of adequately supporting a superconducting magnet is shown in U.S. Pat. No. 3,980,981 to Boom, et al. The structure disclosed in that patent includes a rippled composite superconducting-normal conductor which is laid out in a single layer of turns disposed in a trench formed in the ground. Each ripple in the conductor lies in a plane normal to the net magnetic field experienced by that conductor. The outward force on the conductor is opposed by support columns which engage the conductor at its innermost portions between the ripples. The supporting columns extend radially to an outer support wall which may be formed in bedrock. The columns can be made of insulating material so that the necessary thermal shielding Dewar is accommodated around the conductor with minimal interference from the radial support members.

The single layer magnet coil disclosed in U.S. Pat. No. 3,908,981 has several advantages, including ease of maintenance since both sides of the conductor are readily accessible, a simple construction for the conductor, reduced stress resulting from the rippling in the conductor, accessibility of both sides of the conductor with a mechanical shorting switch to protect against failure of the cooling system, ability to surround the conductor with superfluid helium for maximum cooling efficiency, and low voltage difference levels between turns in the magnet coil. Despite the advantages of the single layer design, all of the current circulating in the superconducting coil must be carried by a single conductor. For magnet designs under consideration for power system load leveling, a current capacity of 750,000 amperes or more would be carried by the single conductor. Additionally, the resultant of the forces on the rippled conductor will be substantially radial, so that a very strong and stable outer support mass is required to carry the loads that will be imposed when the superconductor is carrying current. If the conductor is buried in and surrounded by bedrock, which is intended to carry these radial forces, the bedrock must have reasonably good structural integrity and be stable over time.

The superconducting energy storage magnet shown in U.S. Pat. 4,622,531 to Evssa. et al. has inner and outer coils which are supported and restrained by support structure. The coils experience primarily inwardly directed (toward the supports between the coils) forces. The net outward force on the rippled conductors of the magnet is transferred outwardly on support struts to the walls of the trench in which the superconducting magnet is formed.

For superconducting magnets which are to be formed in trenches or tunnels in the ground, the surrounding soil or bedrock forms part of the support structure which absorbs the outward forces on the superconducting magnets. Magnets in the form of solenoids which have a low aspect ratio (height/diameter less than 0.1) have the advantage that relatively low pressure is applied to the face of the trench in the rock or soil. This advantage allows such low aspect ratio coils to be mounted closer to the ground surface where the soil or rock is ordinarily relatively weaker than the rock surrounding a tunnel formed in deep bedrock. However, the soil in the face of a trench at the top of the trench is generally weaker and less able to carry the radial pressure supplied by the superconducting magnet then the soil or rock at the bottom of the trench. The ripple conductor magnet structure shown in U.S. Pat. Nos. 3,980,981 and 4,622,531 has significant advantages for large energy storage magnets. Nonetheless, the composite conductors in such magnets will experience expansion strains as the magnet is charged and discharged and the current flowing through the magnetic increases and decreases. The "working" of the normal metal of the composite conductor due to the slight bending of the composite conductor that occurs during the charge-up and discharge of the magnet will, over time, increase the effective resistance of the normal metal. This is an important factor with a composite conductor formed utilizing high purity aluminum as the normal conductor because high purity aluminum is particularly susceptible to an increase in resistance with working.

SUMMARY OF THE INVENTION

In accordance with the present invention, a superconducting energy storage magnet is constructed such that it can be mounted in relatively shallow trenches by being arranged so that relatively low radial forces are applied to the top of the outer wall of the trench in which the magnet is mounted. This result is obtained by providing a magnetic coil having coil turns which effectively lie substantially on a surface which defines the frustum of a core so that the coil turns are aligned at an angle with respect to the central axis of the magnet. The turns of the coil are preferably tilted at an angle selected such that the largest pressures are applied by the coil to the base of the trench wall and the lowest pressures (preferably zero pressure) are applied to the top of the trench wall. Thus, the soil in the trench can be weaker than would be required for a cylindrical solenoidal magnet and suitable site locations are more generally available.

The turns of the coil forming the superconducting magnet preferably are rippled so that the conductors are capable of undergoing expansions and contractions during charge-up and discharge without building up damaging strain levels in the conductor. To minimize the amount of working of the metal of the composite conductor during charging and discharging of the magnet and during cool down of the conductor to superconducting temperatures, the ripples of the conductor are preferably formed in a non-circular shape chosen to provide minimum bending of the ripple conductor during charge and discharge and cool down. The minimum bending configuration for the rippled segments provides greater available strain ranges for the conductor and support structure and results in minimum degradation of electrical and structural properties of the composite superconductor.

Further objects, features and advantages of the invention will be apparent from the following detailed description when taken in conjunction with the accompanying drawings.

DETAILED DESCRIPTION OF THE INVENTION

Figure 1:
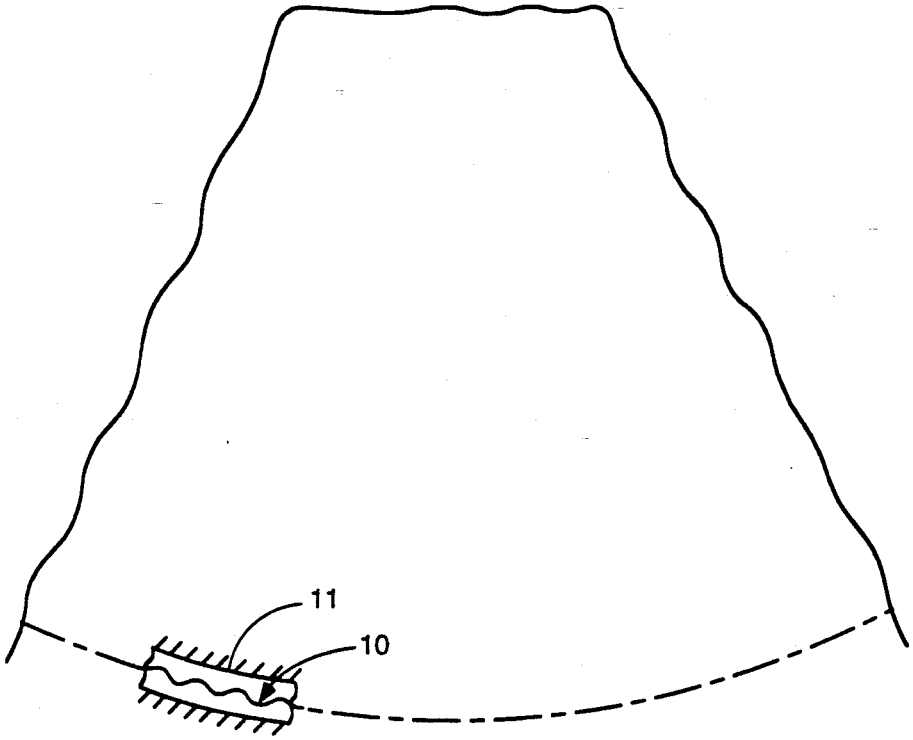
FIG. 1 is a schematic view illustrating the preferred layout of a storage magnet in accordance with the present invention shown illustratively disposed in a trench.
Figure 2:
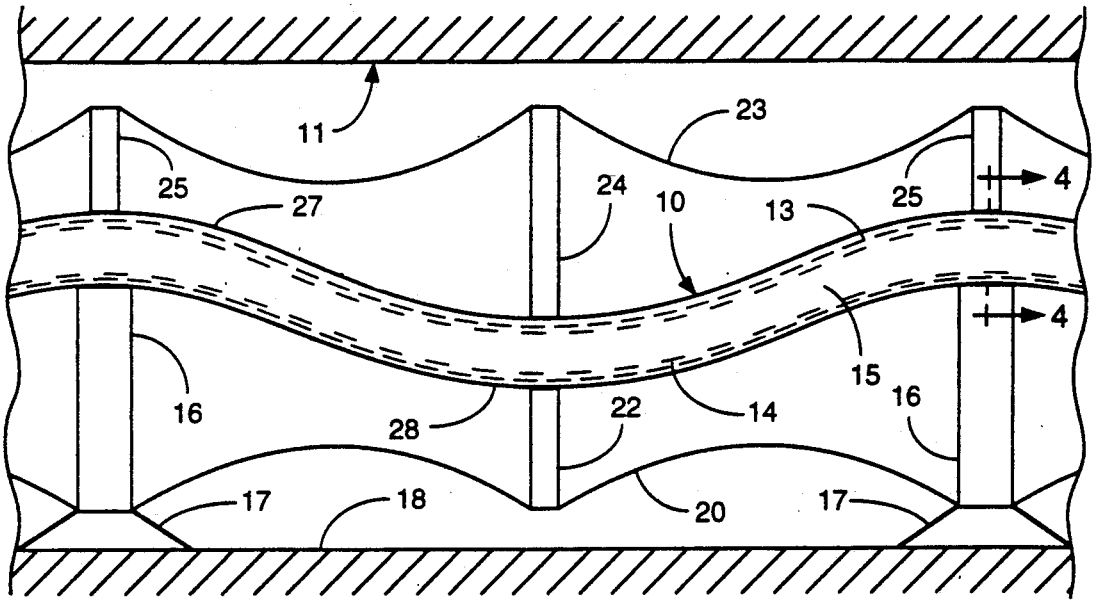
FIG. 2 is a somewhat more detailed plan view of a section of the superconducting coil of the magnet of FIG. 1 between the inner and outer trench walls.

Referring to the drawings, a portion of a superconducting magnet in accordance with the present invention is illustrated at 10 in FIG. 1 in a relative position that it could occupy for a large scale energy storage system constructed in a cylindrical trench 11 excavated from solid earth or bedrock. The radius of the magnet 10 would typically be in the range of several hundred meters, with the trench 11 being in the range of 5 meters wide and 10 to 30 meters deep. A portion of the magnet 10 within the trench 11 is shown in more detail in FIG. 2. The magnet has an inner coil 13 and an outer coil 14 both formed of composite conductors. The two coils are separated and supported by an inner support structure 15, with the inner conductor 13, the outer conductor 14, and the inner support structure 15 all having the general rippled shape illustrated in FIG. 2. An outer support strut 16 engages the support structure 15 at the innermost lobes of the ripples and extends radially outward to anchorages 17 at an outer side wall 18 which surrounds the magnet. The struts 16 support the coil of conductor in the magnet to carry the outward pressure imposed on the coil by the interaction of the current flowing in the coil conductors with the magnetic field. An outer vacuum Dewar 20 extends over the height of the magnet 10 with a concave rippled shape as shown, being attached at one end to the anchorage bases 17 and also being supported against the inwardly directed forces of the vacuum load on the Dewar by support struts 22 which extend outwardly from the inner support structure 15 to the Dewar wall 20. Similarly, an inner Dewar wall 23 is supported against the vacuum load by Dewar support struts 24 and 25 which extend from the inner support structure 15 to the Dewar wall 23 from the outer and inner lobes, respectively of the rippled support structure. Since the net pressure on the magnet structure 10 will be directed radially outward, attachment of struts to the inner wall of the trench 11 is not required. A liquid helium containment vessel has an inner wall 27 and an outer wall 28 closely spaced from the inner coil 13 and outer coil 14, respectively, to contain the liquid helium bath which envelops the composite conductors in the two coils. The foregoing description is illustrative of one of various support and Dewar structures which may be used with the present invention. The general form of the magnet structure and the materials of the magnet may be, for example, those described in U.S. Pat. No. 4,622,531, which is incorporated herein by reference.

Figure 4:
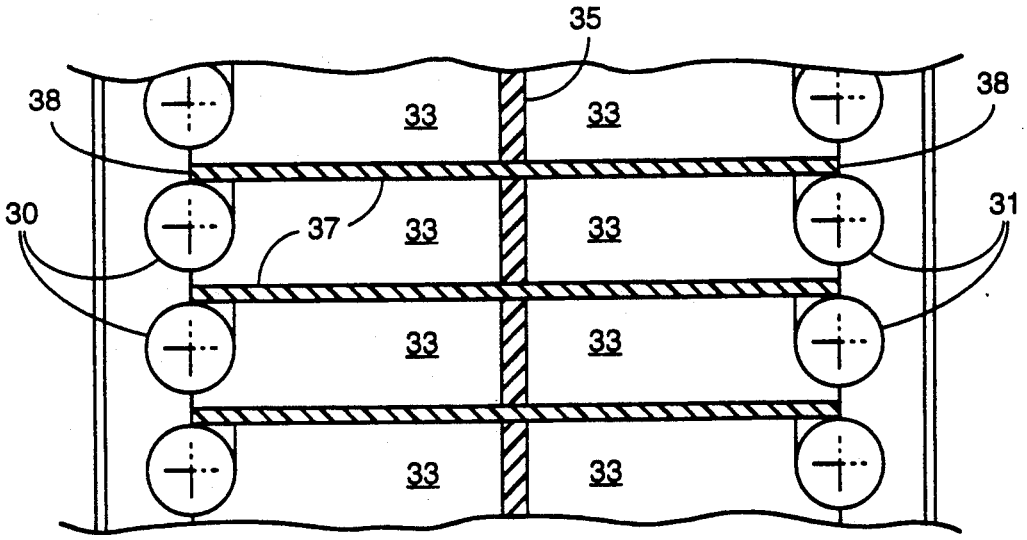
FIG. 4 is a partially schematic cross-sectional view through the magnet coil of the magnet of the invention.

A partial cross-section through the magnet 10 is shown in FIG. 4. The composite conductors 30 of the inner coil 13 and the composite conductors 31 of the outer coil 14 are provided support against axial and inwardly directed magnetic forces by the inner support structure 15. The inner support 15 is preferably a composite structure having a series of rails 33 formed of a metal which is a good conductor of both electricity and heat, such as aluminum, with each rail being associated with one of the turns of either the outer conductor 31 or the inner conductor 30. Each of the rails 33 has a partial circular lip 34 formed therein which conforms to approximately a quarter of the outer circular periphery of the circular conductors 30 and 31. The lip 34 gives axial support to the turns of the conductors 30 and 31 and provides a relatively large contact area over which the magnetically induced force applied by the conductors 30 and 31 can be distributed. A large area of contact between the rails and the conductors 30 and 31 also results in good electrical and thermal conduction between the conductors and the rails. Each of the rails 33 extend circumferentially in parallel with the conductors 30 and 31 and each is spaced from and electrically isolated from adjacent rails by central insulators 35, which separate and insulate rails supporting turns in the two different coils at the same level, and level insulators 37 which separate the rails which support conductors within the same coil. The insulators 35 and 37 may be formed of any suitable good electrically insulating material which also has strong structural strength, such as fiberglass-epoxy composites. It is preferred that the level insulators 37 extend outwardly to ends 38 which contact or are close to the composite conductor beneath to prevent a rail supporting one turn in the coil from shorting to another turn of the same coil. The support rails for each coil may be continuous such that a single support rail may be wound with a composite conductor in contact therewith for all of the turns of the coil.

Figure 3:
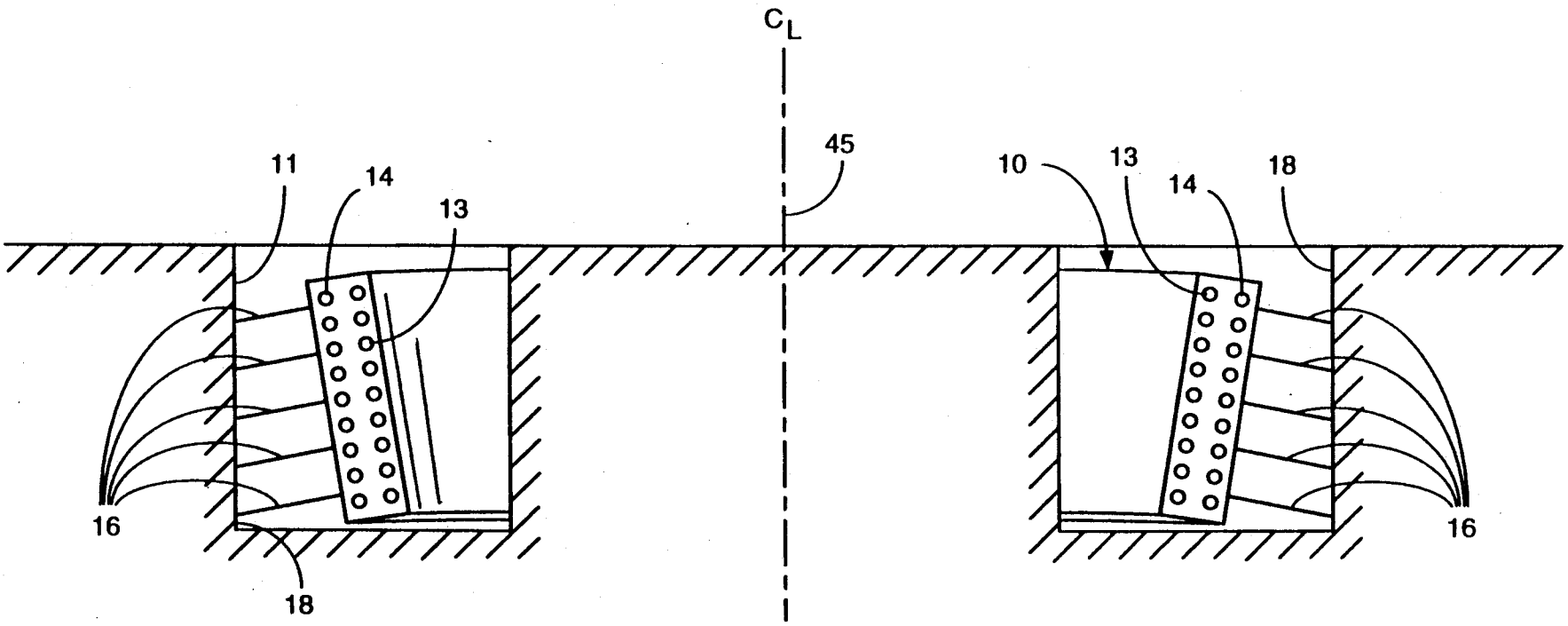
FIG. 3 is a simplified illustrative view of a cross section through the center of the superconducting magnet of the present invention disposed in a trench.

A highly simplified cross-sectional view through the energy storage magnet of the invention as mounted in the trench 11 is shown in FIG. 3. It is understood that the actual radius of the trench would be substantially larger than that shown in FIG. 3 and that the trench may be formed as a tunnel in the ground, particularly in bedrock. In accordance with the present invention, the superconducting magnet 10 is formed such that the turns of conductor forming the coils 13 and 14 are tilted with respect to the center line 45 of the magnet. The tilt angle of the coils forming the magnet 10 is shown exaggerated in FIG. 3 for purposes of illustration. The turns of conductor in the coils 13 and 14 are arranged in the present invention effectively to lie on a truncated conical surface (a frustum) rather than a cylindrical surface, with the broadest part of the frustum at the bottom, as illustrated in FIG. 3. The support structure 15 between the coils 13 and 14 is also effectively tilted in a generally frustum shape. The support struts 16 preferably extent outwardly from the coil 10 to mounting points on the sidewall 18 of the trench 11 at right angles to the coil of the conductors. The tilting of the coils 13 and 14 with respect to the center line of the magnet serves the purpose of reducing the radial forces applied by the magnet to the sidewall at the top of the magnet (nearer the top of the trench or tunnel) and to maximize such forces at the bottom of the magnet (at the bottom of the trench or tunnel).

Figure 5:
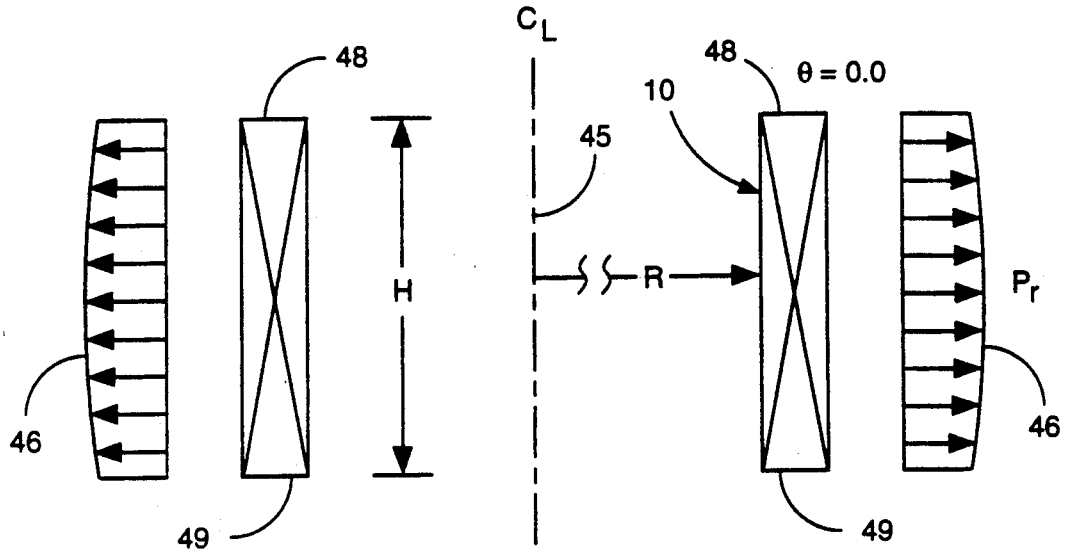
FIG. 5 is a schematic diagram illustrating the radial pressure distribution for a solenoidal magnet wound parallel to the center line of the solenoid.
Figure 6:
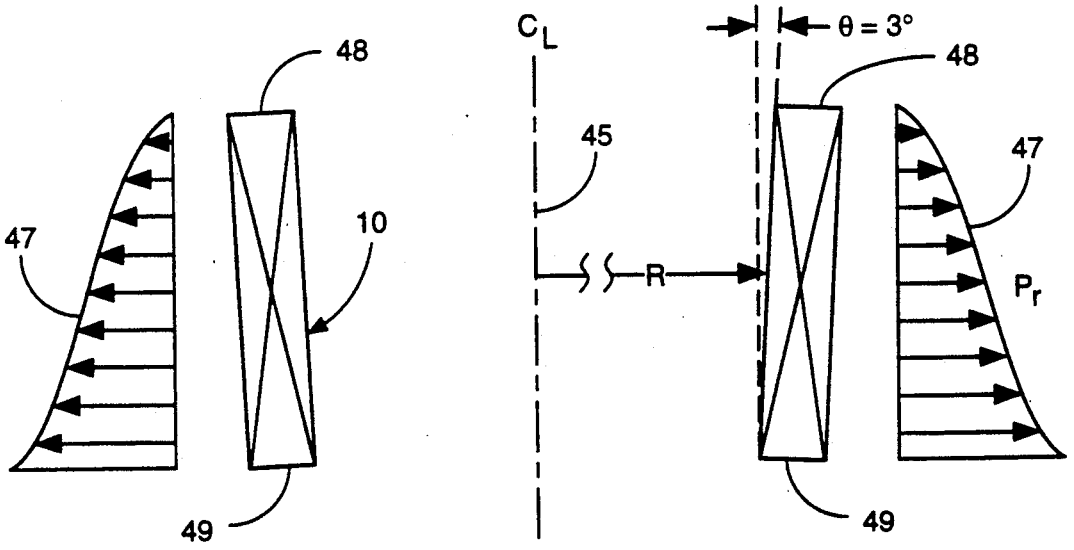
FIG. 6 is an illustrative schematic view of the radial pressure distribution for a coil tilted at an angle of 3° with respect to its center line.

The effective radial pressure applied by the magnet 10 at various tilt angles for a magnet of aspect ratio 0.03 is illustrated in FIGS. 5 and 6. FIG. 5 illustrates the pressure distribution 46 as a function of the height of the magnet 10 where the coils a re parallel to the center line (a true solenoid). The pressure from the magnet has a substantially uniform distribution, with a slight bowing outwardly in the middle so that the middle of the magnet experiences the greatest outward pressure. However, high pressures are also exerted at the top 48 and bottom 49 of the magnet 10. FIG. 6 illustrates the pressure distribution 47 as a function of height for a magnet 10 having its coils tilted at an angle of about 3° with respect to the center line 45. Such tilting results in a reduction of the pressure (to zero for an angle of about 3° ) at the top wide end 48 of the magnet coil and to a maximum pressure at the bottom 49 narrow end of the magnet coil.

The optimum amount of tilt of the coils with respect to the center line is generally the angle $\theta$ that yields a substantially zero pressure at the top end 48 of the magnet and the maximum radial pressure at the bottom end 49 of the magnet for a particular choice of the aspect ratio. The aspect ratio "$\beta$" is equal to the height of the (substantially) solenoidal magnet divided by its diameter. The total force applied by the magnet does not change substantially with change in tilt angle for low aspect ratio magnets.

Figure 7:
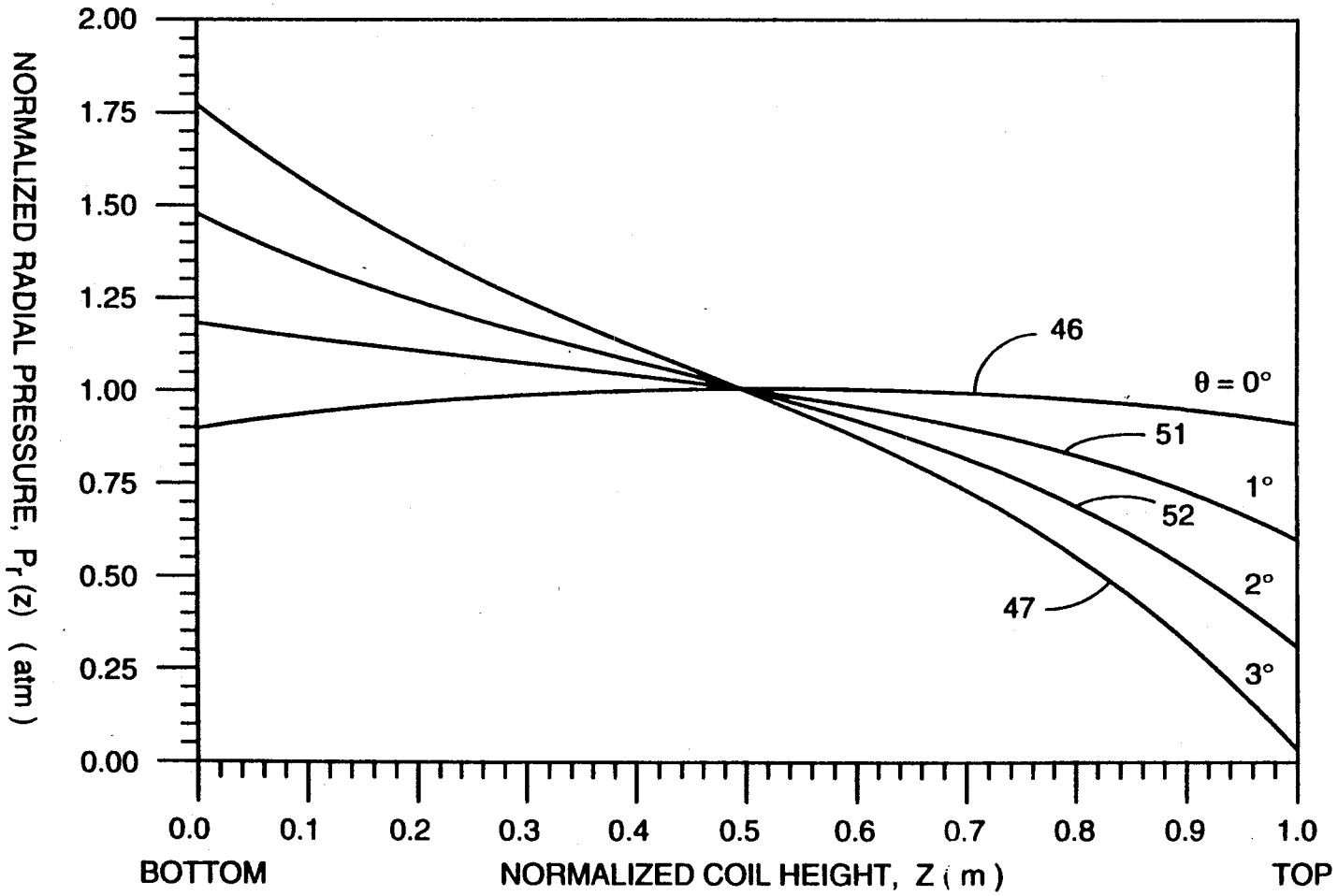
FIG. 7 are plots showing normalized radial pressure versus normal coil height for magnet coils (height/diameter=0.03°) having coil turn orientations between 0° and 3° to the center line.

For an aspect ratio $\beta$ such that $0.01 \leqq 0.1$, the critical angle $\theta_c$ that yields a zero pressure on the top turn of the magnet is relatively small. FIGS. 5 and 6 illustrate the radial pressure distribution at two tilt angles (0° and 3°) for a magnet having an aspect ratio of $\beta=0.03$. FIG. 7 shows plots of the normalized radial pressure versus normalized coil height at angles $\theta=0°$ (the curve 46), $\theta=1°$ (the curve 51), $\theta=2$. (the curve 52) and $\theta=3°$ (the curve 47). For a solenoid coil (or what is substantially a solenoid coil in the present invention) having an aspect ratio $\beta=0.03$, increasing the angle of tilt beyond 3 (the critical angle) will result in negative (inward) pressure at the top of the coil. The smaller the aspect ratio, the smaller will be the critical angle $\theta_c$. In the present invention, the preferred angle of tilt is just equal to or slightly less than the critical angle for the particular coil so that the pressure at the top of the coil is substantially zero.

As illustrated in FIG. 4, a preferred magnet structure 10 in accordance with the present invention has two sets of coils 13 and 14 composed of composite conductors 30 and 31, respectively. The turns of conductors 30 in the coil 13 and the turns of conductor 31 in the coil 14 are aligned substantially above one another as illustrated in FIG. 3. In accordance with the present invention, the conductors in each of the coils 13 and 14 lie on an imaginary surface essentially defining the frustum of a cone having a particular conical angle. Preferably, the angle of the frustum surface for each of the coils 13 and 14 is substantially equal to the critical angle for each coil at its relative radial position. Because the radius distance of the magnet 10 is generally much larger (100 meters or more) than the spacing between the conductors 30 and 31 (a meter or less), for practical purposes the conductors 30 and 31 may be uniformly spaced over the vertical height of the magnet 10, i.e., the effective conical surface on which the conductors 30 and 31 lie are parallel.

The magnet structure of the present invention may utilize more than one magnet 10. For example, two of the magnets 10, each having two sets of coils 13 and 14 as illustrated in FIG. 3, may be mounted horizontally adjacent to one another in the trench. Generally, the conductors of each of the magnets would be connected to one another so that the same current would flow through both magnets.

The rippled conductor structure as described in U.S. Pat. No. 3,980,981 limits the cooldown strain and the overall stress in the conductor. A stiff ripple structure also helps to carry the radial magnetic pressure. By properly optimizing the shape of the ripples in the conductor in accordance with the present invention, it is possible to achieve a near zero bending of the conductors during cooldown and charge and discharge of the magnet, thereby greatly reducing the cyclic strains in the conductors. The optimum ripple shape to obtain minimum bending moments can be determined in the manner set forth below.

The minimum bending ripple shape $R_*(s)$ satisfies the following expression $$\Pi(R_*)=\min \Pi(R)$$

where $$\Pi(R)=\int M^2(R,s)ds$$

is the bending strain, R(s) is a position vector function that defines the ripple shape as a function of circumferential position S, and M is the bending moment of the structure and is a function of R(s) and S. An iteration method, as described below, can be used to solve for $R_*(S)$. The method starts with a circular ripple shape and iteratively improves the shape until the structure reaches a near zero bending ripple.

Figure 8:
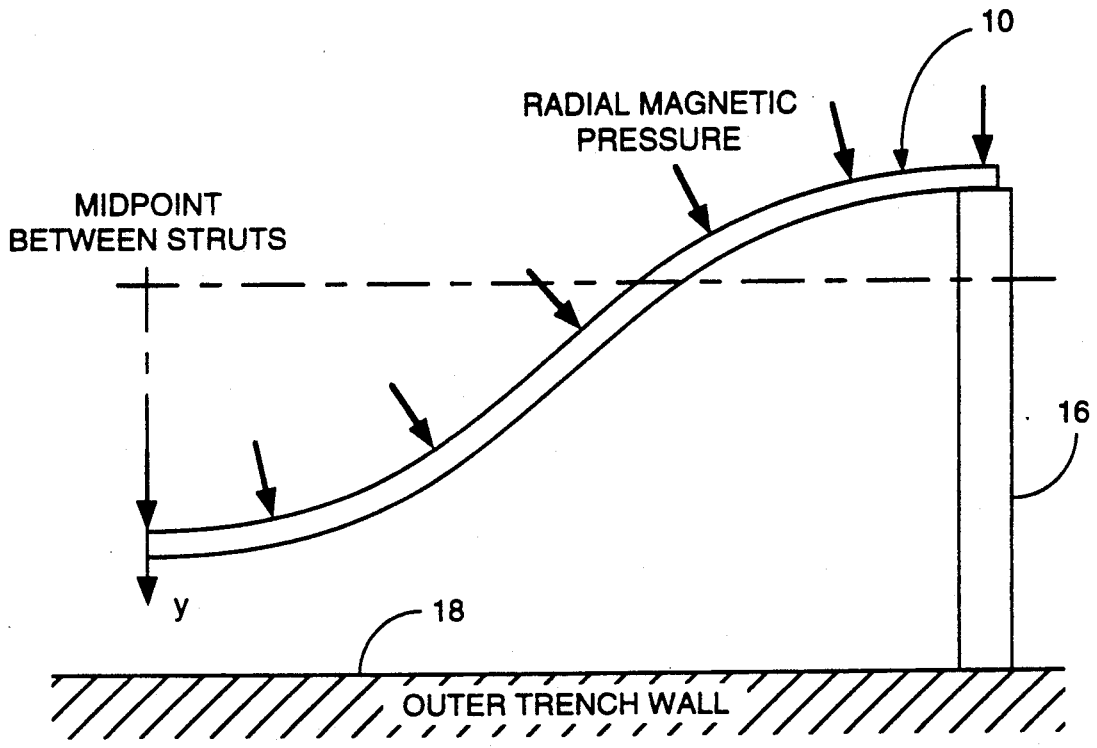
FIG. 8 is a schematic view of a section of ripple conductor illustrating the radial magnetic pressure.

One-half of the magnet structure 10 between two struts 16 is illustratively shown in FIG. 8. Because of symmetry, the pressure calculations on the other half of the structure is identical. To determine the optimum shape, a starting ripple shape $R_0(s)$ is assumed (where S is the circumferential position), and the ripple shape is improved iteratively in the following manner. Based on the initial ripple shape $R_0$ the magnetic pressure is calculated. The displacement, $\delta$, of the structure in FIG. 8 is then calculated under that radial magnetic pressure. The boundary conditions are $u=0$ and $\leftarrow=0$ at the midpoint between the struts 16, and $u=0$, $v=\Delta$ and $\leftarrow=0$ at the locations of the struts, where u is the circumferential displacement of the structure, v is the radial displacement, $\theta$ is the tilt angle of the structure cross-section, and $\Delta$ is the radial displacement at the position of the strut. The radial strut displacement $\Delta$ is caused by strut deformations and displacements of the outer wall 18 of the trench.

A new ripple shape is calculated iteratively by vector addition using the following expression for the Kth iteration:

$$R_K=R_{K-1}+\alpha(\delta-\delta_s)$$

where $\delta_s$ is the displacement vector at a strut location, $\alpha$ is a relaxation factor that may be needed to avoid oscillation in the calculations, and $R_{K-1}=R_0$ for the first iteration. The choice of the value of the factor $\alpha$ depends on the radial pressure and the stiffness of the structure.

Figure 9:
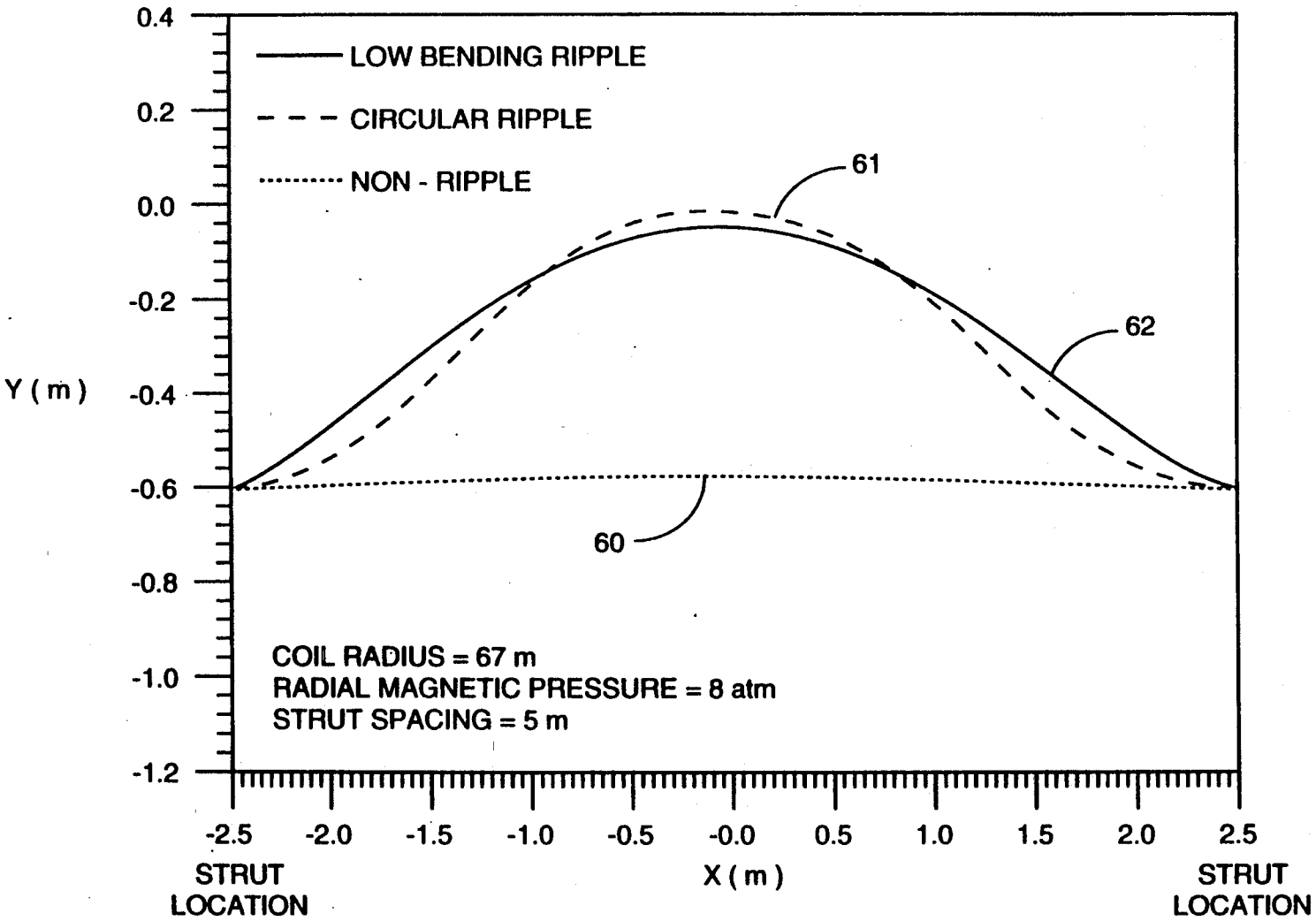
FIG. 9 is a schematic diagram showing the shapes of a minimum bending ripple section and a circular ripple section.
Figure 10:
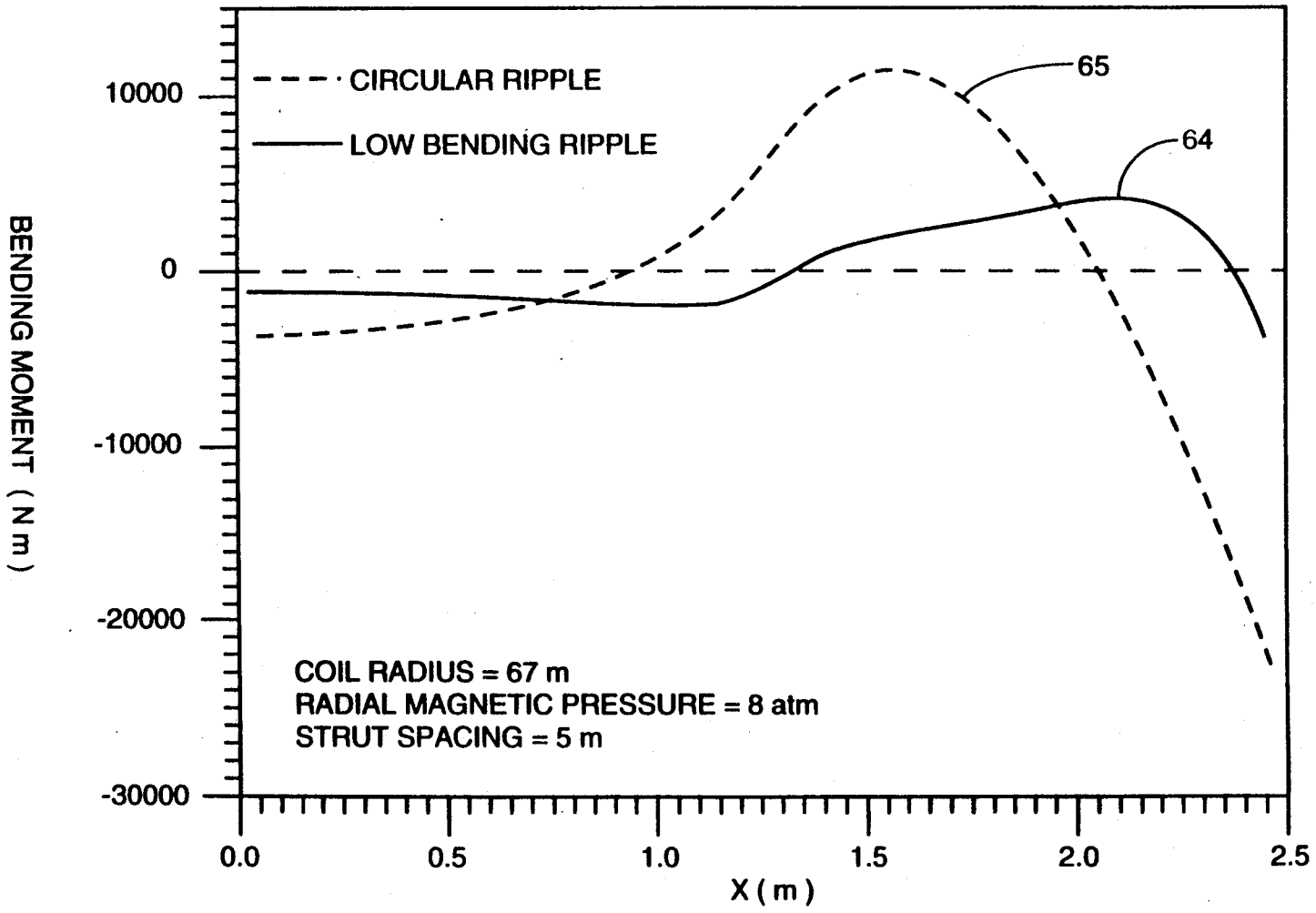
FIG. 10 is a graph illustrating the bending moment over a half of a section of ripple in a coil for a circular ripple structure and a minimum bending ripple structure.

With the radial magnetic pressure effectively imposed upon it, the computed ripple sections tends to deform into a new ripple shape having lower strain energy, i.e., it tries to reduce its bending moments. Eventually, after several iterations the conductor structure reaches a near-zero bending ripple shape. The curve 62 in FIG. 9 is a plot of the minimum bending ripple shape that is calculated in the foregoing manner starting with a pure circular ripple 61. The overall radius of the magnet is illustrated by the dashed line 60 shown in FIG. 9. As illustrated in the graph of FIG. 10, the bending moment as a function of distance X(m) from the center between two struts is much less for the minimum bending ripple shape, as illustrated by the graph labeled 64 in FIG. 10, than for the circular ripple shape illustrated by the graph 65.

Figure 11:
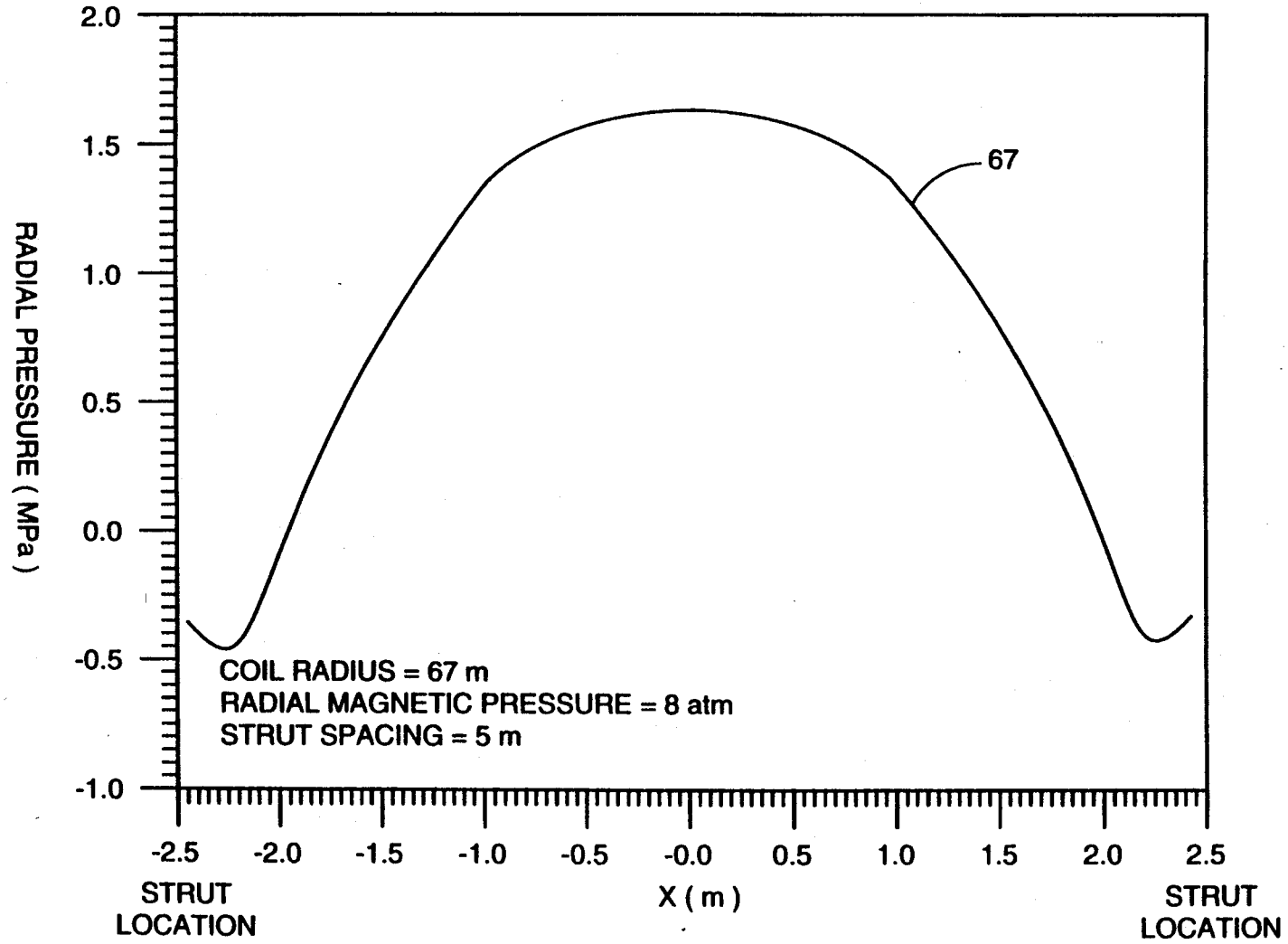
FIG. 11 is a graph illustrating the variation of radial magnetic pressure over a section of a minimum bending ripple.

The effect of the ripple shape on the distribution of the magnetic pressure on a low aspect ratio magnet is significant. FIG. 11 shows a plot 67 of the radial magnetic pressure on the low bending ripple conductor structure over the space between struts 16. The local pressures on the conductor change with the shape of the ripple but the average pressure remains the same.

Figure 12:
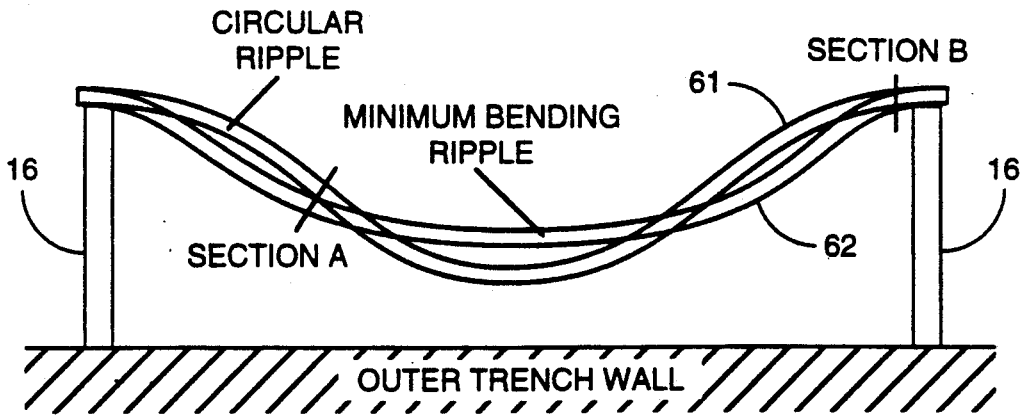
FIG. 12 is an illustration of the shapes of a minimum bending ripple and a circular ripple between support struts.
Figure 13:
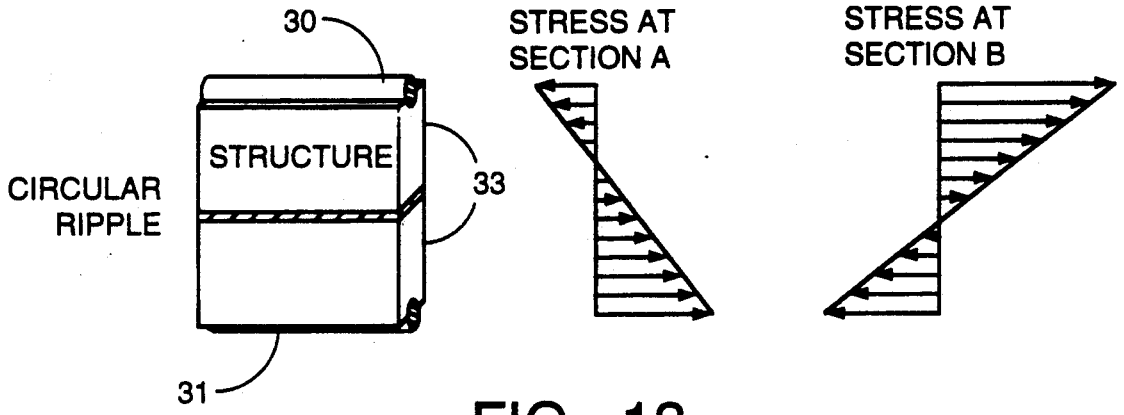
FIG. 13 is an illustration of the stresses at two different cross-sections through the circular ripple structure of FIG. 12.
Figure 14:
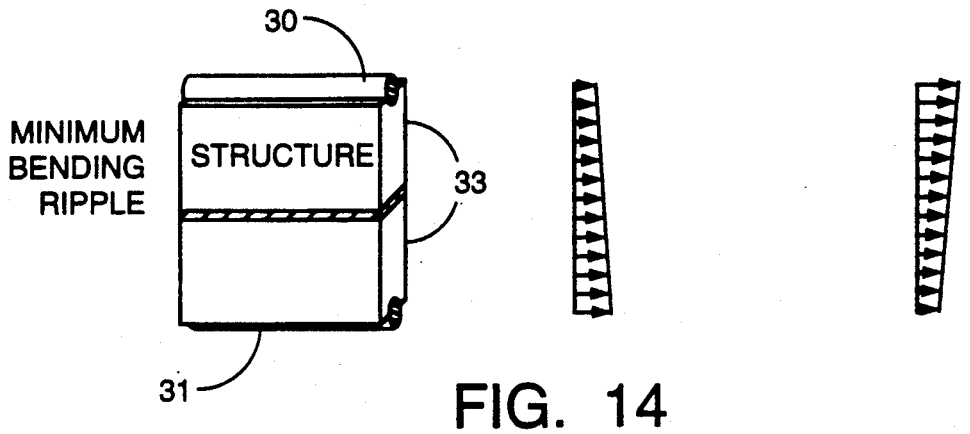
FIG. 14 is an illustration of the stresses at two different cross-sections through the minimum bending ripple structure of FIG. 12.

FIG. 12 illustrates the relative shape of a segment 61 of circular ripple conductor and a segment 62 of minimum bending ripple conductor between struts 16. The minimum bending segment 62 has a smaller radius of curvature than the circular segment 61 at the struts 16. The stresses in the support members 33 and the conductors 30 and 31 for the circular and minimum bending shapes 61 and 62 are illustrated in FIGS. 13 and 14, respectively, for cross-sections at A and B in FIG. 12. At both sections, the stresses are found to be much lower for the minimum bending ripple shape. Because the support structure 33 is in close contact with the conductors 30 and 31, the strain in the support structure at its edges will be reflected in strain in the composite conductors 30 and 31.

The minimum bending ripple structure has greatly reduced structural stresses, and the very small cyclic strain in the composite conductors allows the normal conductor in the composite conductor to retain its high conductivity. This is a particularly important advantage for very high purity aluminum conductors (e.g., those having less than one part per million impurity). As a consequence, the composite conductors remain more stable than in magnets where cyclic strains are greater. In addition, because the frictional energy disturbance is proportional to the square of the bending moment, the minimum bending ripple structure has a very small frictional energy disturbance, resulting in a more reliable magnet.

The foregoing ripple shape obtained by the iteration procedure is the preferred shape at operating temperature. To obtain the corresponding initial ripple shape at room temperature, a warm up thermal load is applied to the structure and the displacements are calculated. The iteration procedure does not ensure low cooldown stresses in the structure. The cooldown stresses may be too high if there is not enough extra length in the conductor (where "extra length" is the ripple conductor length minus circular non-ripple conductor length). The greater the extra length in the starting ripple shape $R_0$ the less the stresses. Although the final ripple shape may be different than the initial shape, it will still have more extra length to thereby allow the cooldown stress to be reduced.

The table below compares the maximum cooldown stress in the structure, the average conductor cyclic strain during daily operation and the percentage of extra length preferred for different starting ripple shapes in an exemplary structure having two magnets 10 (4 layers of coils). All of the initial shapes are circular ripples. As the radius of the circular ripple gets smaller, it is seen that the extra ripple length gets longer, the cooldown stresses decrease, and the conductor cyclic strains get smaller.

Cyclic Strains and Cooldown Stresses of 4-Layer Low Bending Ripple Structures (strut spacing = 5 m, structure thickness = 10.16 cm, average radial pressure = 8 atm, MPa = mega Pascals

| Initial Circular Ripple Radius | Maximum Structure Cooldown Stress | Average Conductor Cyclic Strain | Extra Length |
|---|---|---|---|
| 5 m | 229 MPa | 0.0355% | 1.48% |
| 4 m | 197 MPa | 0.0311% | 1.84% |
| 3 m | 153.5 MPa | 0.0286% | 2.82% |
| 2.5 m | 127.7 MPa | 0.0269% | 3.89% |

It is preferred in the present invention to have the coils 13 and 14 both tilted (lying on a surface which forms a frustum of a cone) and moreover defining a ripple shape which provides minimum bending.

It is understood that the invention is not confined the particular embodiments described herein, but embraces such modified forms thereof as come within the scope of the following claims.

What is claimed is:

1. A superconducting magnet comprising:

(a) a coil of turns of conductor including at least a supercondcting composite material, the turns of conductor lying substantially on a surface which defines a frustum of a cone having a wide end and a narrow end, such that the outward pressure as a result of current flowing through the conductor in the magnetic field produced by the magnet at the wide end of the coil is less than the outward pressure at the narrow end of the coil; and (b) means for supporting the coil of conductors in the magnet to carry the outward pressure imposed on the coil by the interaction of the current flowing in the conductor with the magnetic field, wherein the turns of the conductor in the coil have outwardly bowed ripples therein and inner portions between the ripples with the ripple pattern extending around the circumferential periphery of the magnet structure, and wherein the means for supporting includes support struts extending from a surrounding support mass to engage the conductor at the inwardly bowed portions of the rippled conductor forming the coil.

2. The superconducting magnet of claim 1 wherein the angle of the conical surface with respect to its central axis is selected such that the outward pressure at the widest end of the coil is substantially zero.

3. The superconducting magnet of claim 2 wherein the aspect ratio is equal to the height of the coil divided by its diameter is approximately 0.03 and the angle of the conical surface with respect to the central axis is approximately 3° .

4. The magnet structure of claim 1 further comprising a second, inner coil of turns of conductor including at least a superconducting composite material, the second coil disposed adjacent to the first coil with each turn of the second coil at substantially the same level as a turn on the first coil, and including an inner support structure between the first and second coils and engaged to the conductors of each of the coils.

5. The superconducting magnet of claim 1 wherein each of the ripples in the conductor is formed in a shape which undergoes minimum bending during changes in the level of current flowing through the conductor.

6. The superconducting magnet of claim 5 wherein the conductor includes a composite of superconductor and a normal conductor and wherein the normal conductor is high purity aluminum.

7. A superconducting magnet comprising:

(a) a coil of turns of conductor including at least a superconducting composite material, the conductor having outwardly bowed ripples therein and inner portions between the ripples with the ripple pattern extending around a substantially circular circumferential periphery, (b) support struts extending from an outer supporting mass to support the coil of ripple conductor at the innermost portions of the ripples of the conductor, and wherein the ripples are formed to have a non-circular shape which undergoes minimum bending during changes in the current flowing through the conductor with a magnetic field applied to the conductor, and wherein the ripple shape is calculated iteratively by vector addition using the following expression for the Kth iteration:

$$R_K = R_{K-1} + \alpha(\delta - \delta_S)$$

where $\delta$ is the displacement vector at a position along the ripple, $\delta_S$ is the displacement vector at a strut location, $\alpha$ is a relaxation factor selected to avoid oscillation in the calculations, and $R_{K-1} = R_0$ for the first iteration where $R_0$ is a chosen initial ripple shape.

8. The superconducting magnet of claim 7 wherein the conductor is a composite conductor formed of a superconductor and a normal conducting high-purity aluminum.

9. The superconducting magnet of claim 7 wherein the coil is formed of multiple turns of conductor with the turns of conductor arrayed one above the other, each turn of conductor having ripples therein with a minimum bending ripple shape.

10. The superconducting magnet of claim 9 including a second, inner coil of conductor including at least a superconducting composite conductor, the inner coil disposed adjacent to the first coil, the second coil formed of turns of conductor having outwardly bowed ripples therein and inner portions between the ripples with the ripple pattern extending around the circumferential periphery of the magnet and each ripple having a minimum bending ripple shape.

11. A superconducting magnet comprising:

(a) a coil of turns of conductor including at least a superconducting composite material disposed in a trench in the ground with an outer sidewall of the trench surrounding the coil, the turns of conductor lying substantially on a surface which defines a frustum of a cone having a top wide end and a bottom narrow end such that the outward pressure as a result of current flowing through the conductor in the magnetic field produced by the magnet at the top end of the coil is less than the outward pressure at the bottom end of the coil; and (b) means for supporting the coil of conductors in the magnet to carry the outward pressure imposed on the coil by the interaction of the current flowing in the conductor with the magnetic field to the outer sidewall, the means including support struts extending from the coil of conductors to the outer sidewall.

12. The superconducting magnet of claim 1 wherein the angle of the conical surface with respect to its central axis is selected such that outward pressure at the top end of the coil which is imposed on the sidewall is substantially zero.

13. The superconducting magnet of claim 16 wherein the aspect ratio equal to the height of the coil divided by its diameter is approximately 0.03 and the angle of the conical surface with respect to the central axis is approximately 3°.

14. The magnet structure of claim 11 further comprising a second, inner coil of turns of conductor including at least a superconducting composite material, the second coil disposed adjacent to the first coil with each turn of the second coil at substantially the same level as a turn on the first coil, and including an inner support structure between the first and second coils and engaged to the conductors of each of the coils.

15. The superconducting magnet of claim 11 wherein the turns of the conductor in the coil have outwardly bowed ripples therein and inner portions between the ripples with the ripple pattern extending around the circumferential periphery of the magnet structure.

16. The superconducting magnet of claim 15 wherein the support struts extend from the surrounding sidewall to engage the conductor at the inwardly bowed portions of the rippled conductor forming the coil.

17. The superconducting magnet of claim 16 wherein each of the ripples in the conductor is formed in a shape which undergoes minimum bending during changes in the level of current flowing through the conductor.

18. The superconducting magnet of claim 17 wherein the conductor includes a composite of superconductor and a normal conductor and wherein the normal conductor is high purity aluminum.

19. A superconducting magnet comprising:

(a) a coil of turns of conductor including at least a superconducting composite material, the turns of conductor lying substantially on a surface which defines a frustum of a cone having a wide end and a narrow end such that the outward pressure as a result of current flowing through the conductor in the magnetic field produced by the magnet at the wide end of the coil is less than the outward pressure at the narrow end of the coil, the turns of the conductor in the coil having outwardly bowed ripples therein and inner portions between the ripples with the ripple pattern extending around the circumferential periphery of the magnet structure; and (b) support struts extending from a surrounding supporting mass to engage the conductor at the inwardly bowed portions of the rippled conductor forming the coil.

20. The superconducting magnet of claim 19 wherein the angle of the conical surface with respect to its central axis is selected such that the outward pressure at the top end of the coil is substantially zero.

21. The superconducting magnet of claim 20 wherein the aspect ratio equal to the height of the coil divided by its diameter is approximately 0.03 and the angle of the conical surface with respect to the central axis is approximately 3°.

22. The magnet structure of claim 19 further comprising a second, inner coil of turns of conductor including at least a superconducting composite material and formed with ripples therein, the second coil disposed adjacent to the first coil with each turn of the second coil at substantially the same level as a turn on the first coil, and including an inner support structure between the first and second coils and engaged to the conductors of each of the coils.

23. The superconducting magnet of claim 19 wherein each of the ripples in the conductor is formed in a shape which undergoes minimum bending during changes in the level of current flowing through the conductor.

24. The superconducting magnet of claim 23 wherein the composite conductor includes a superconductor and a normal conductor and wherein the normal conductor is high purity aluminum.

* * * * *

UNITED STATES PATENT AND TRADEMARK OFFICE

CERTIFICATE OF CORRECTION

PATENT NO. : 5,237,298

DATED : August 17, 1993

INVENTOR(S) : Roger Boom, et al.

It is certified that error appears in the above-indentified patent and that said Letters Patent is hereby corrected as shown below:

In column 2, line 29 of the patent, "Evssa," should be --Eyssa,--

In column 5, line 59 of the patent, "extent" should be --extend--

In column 6, line 5 of the patent, "a re" should be --are--
line 10.

In column 6, line 36 of the patent, "$\theta$=2," should be --$\theta$=2°--

In column 6, line 39 of the patent, "beyond 3" should be --beyond 3°--

In column 7, line 43 of the patent, "←=0" should be --$\theta$=0--

In column 7, line 45 of the patent, "←=0" should be --$\theta$=0--

In column 7, line 60 of the patent, "factor αdepends" should be --factor α depends--

In column 9, line 47 of the patent, "support" should be --supporting--

UNITED STATES PATENT AND TRADEMARK OFFICE

CERTIFICATE OF CORRECTION

PATENT NO. : 5,237,298

DATED : August 17, 1993

INVENTOR(S) : Roger Boom, et al

It is certified that error appears in the above-indentified patent and that said Letters Patent is hereby corrected as shown below:

In column 11, line 8 of the patent, "claim 16" should be --claim 12--

Signed and Sealed this

Twelfth Day of April, 1994

Bruce Lehman

*Attest:*

BRUCE LEHMAN

*Attesting Officer*

*Commissioner of Patents and Trademarks*